US007100549B2

(12) United States Patent
Humphries

(10) Patent No.: US 7,100,549 B2
(45) Date of Patent: Sep. 5, 2006

(54) MECHANISM INCLUDING A PISTON-AND-CYLINDER ASSEMBLY

(76) Inventor: Robin Humphries, Hatchgate Farm, Plough Lane, Bramshill, nr Hook, Hampshire (GB) RG27 OJX ( * ) Notice: Subject to any disclaimer, the term of this patent is extended or adjusted under 35 U.S.C. 154(b) by 0 days.

(21) Appl. No.: 10/509,907

(22) PCT Filed: Mar. 25, 2003

(86) PCT No.: PCT/GB03/01283

§ 371 (c)(1),
(2), (4) Date: Apr. 20, 2005

(87) PCT Pub. No.: WO03/083264

PCT Pub. Date: Oct. 9, 2003

(65) Prior Publication Data

US 2005/0172918 A1 Aug. 11, 2005

(30) Foreign Application Priority Data

Mar. 28, 2002 (GB) ..... 0207390.6
Jul. 12, 2002 (GB) ..... 0216258.4
Sep. 19, 2002 (GB) ..... 2002/004296

(51) Int. Cl.
*F02B 75/18* (2006.01)

(52) U.S. Cl. ..... 123/56.2; 123/54.3

(58) Field of Classification Search ..... 123/56.2, 123/55.3, 54.3, 50 A, 197.1, 197.3
See application file for complete search history.

(56) References Cited

U.S. PATENT DOCUMENTS 2,173,303 A * 9/1939 Koehler ..... 123/55.3
3,945,358 A * 3/1976 Collins ..... 123/50 A
5,553,574 A * 9/1996 Duncalf ..... 123/197.3
6,622,471 B1 9/2003 Nagel

FOREIGN PATENT DOCUMENTS

EP 1 152 138 A2 11/2001

* cited by examiner

*Primary Examiner*—Stephen K. Cronln
*Assistant Examiner*—Hyder Ali
(74) *Attorney, Agent, or Firm*—Jackson Walker L.L.P.; Christopher J. Rourk

(57) ABSTRACT

A mechanism comprising a piston-and-cylinder assembly including a piston housed in a cylinder is provided. The mechanism includes a pin member passing through the piston and a guide member having a guide recess accommodating an end of the pin member, the guide recess being so shaped and orientated in relation to the piston-and-cylinder assembly that a common axis exists between the guide recess and the piston-and-cylinder assembly. The guide member and the piston-and-cylinder assembly are mounted so as to be rotatable relative to each other about the common axis. The guide recess includes an inner periphery and an outer periphery, where the inner and outer peripheries include respective mid-portions where the periphery is narrowest lying between two end lobe portions, for guiding the pin member continuously in a path which includes two end lobe portions separated by a narrower mid-portion. Rotation of the guide member and the piston-and-cylinder assembly relative to each other causes the piston to sweep up and down the cylinder. The radius of curvature along the narrowest part of the narrower mid-portion of the inner periphery of the guide recess is always larger than the radius of curvature along the end lobe portion of the outer periphery of the guide recess.

20 Claims, 10 Drawing Sheets

Figure 1:
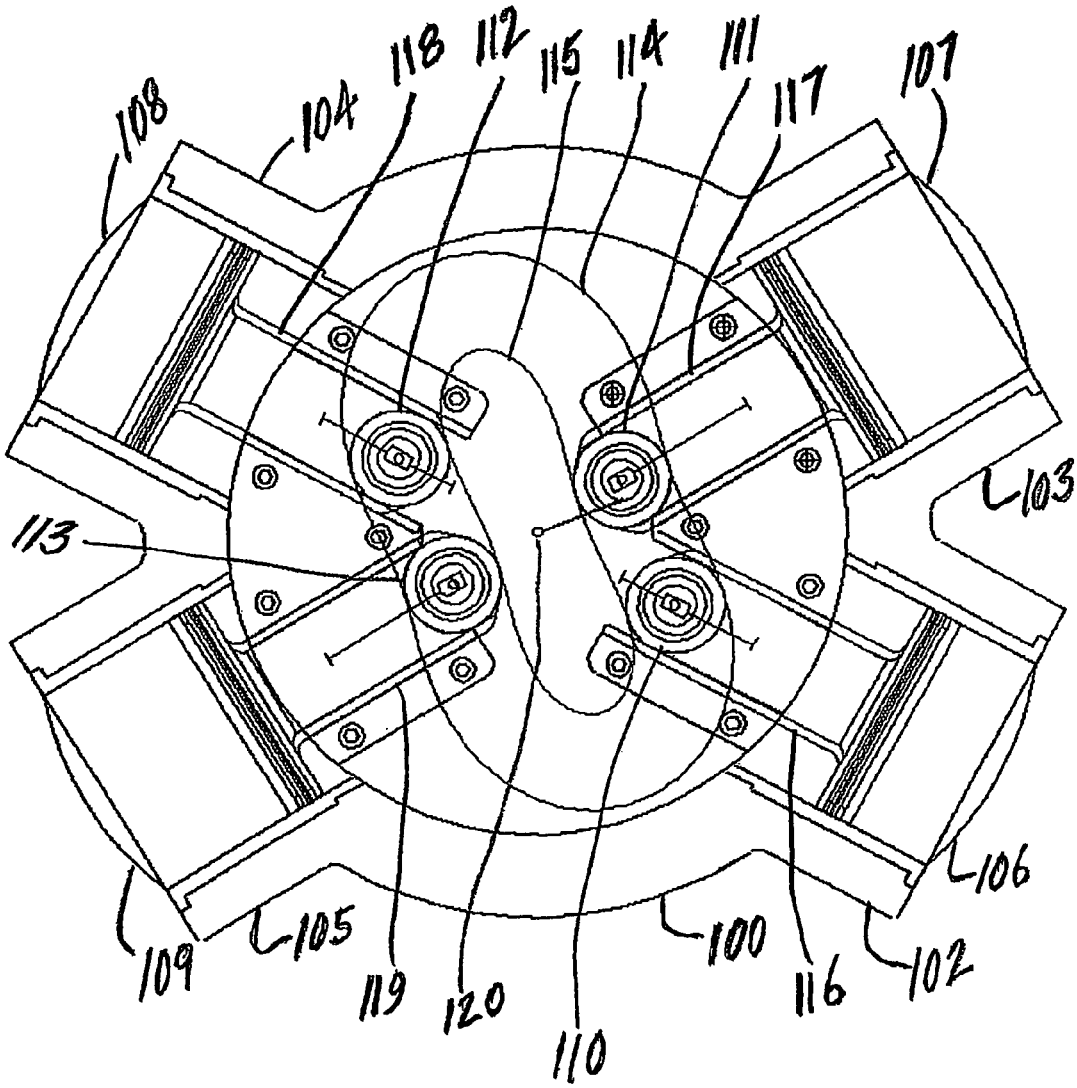

115
114
A
F
244
243
242
B
E
C
241
D 241
115
114
A
F
M
B
E
C
N
D

Fig 8
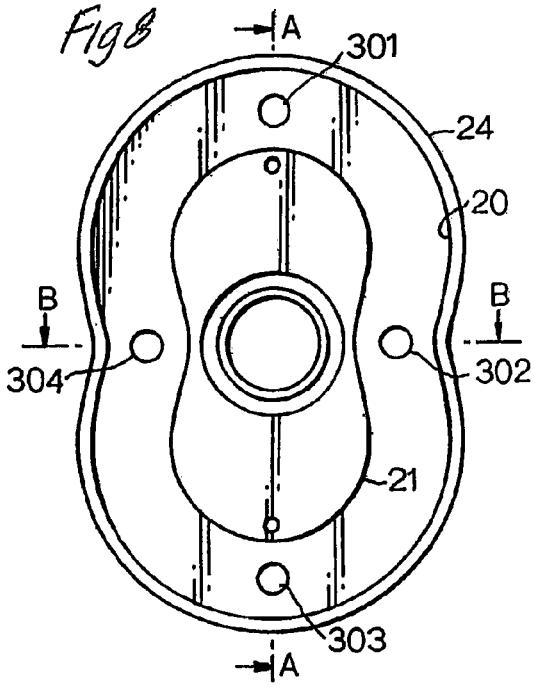
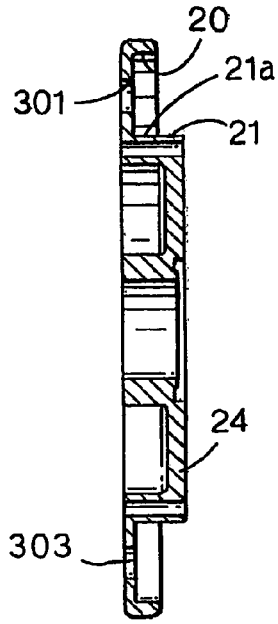
Fig 9
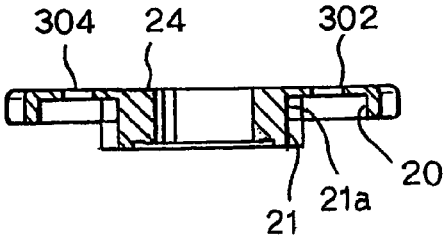
Fig 10
Fig 11
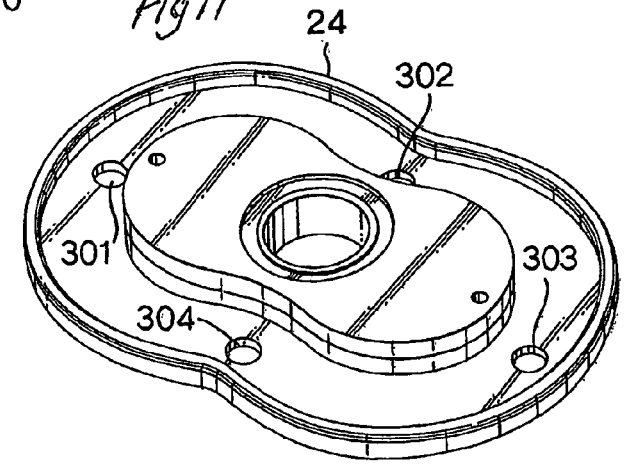

MECHANISM INCLUDING A PISTON-AND-CYLINDER ASSEMBLY

CROSS-REFERENCE TO RELATED APPLICATION

This application claims the benefit of Great Britain patent application 0207390.6, filed Mar. 28, 2002, Great Britain patent application 0216258.4, filed Jul. 12, 2002, PCT/GB2002/004296, filed Sep. 19, 2002, and is a national phase application filed under 35 U.S.C. 371(c) claiming priority to PCT/GB03/01283, all of which are hereby incorporated by reference for all purposes.

The invention relates to a mechanism including a piston-and-cylinder assembly.

The invention provides a mechanism including:

a piston-and-cylinder assembly including a piston housed in a cylinder, a pin member passing through the piston and a guide member having a guide recess accommodating an end of the pin member, the guide recess being so shaped and orientated in relation to the piston-and-cylinder assembly that a common axis exists between the guide recess and the piston-and-cylinder assembly, the guide member and the piston-and-cylinder assembly being so mounted as to be rotatable relative to each other about the common axis and the guide recess being a figure-8 in shape bounded by an outer and an inner periphery, for guiding the pin member continuously in a figure-8 path, causing the piston to sweep up and down the cylinder, when the guide member and the piston-and-cylinder assembly rotate relative to each other, the radius of curvature of the section of the outer periphery of the guide recess determining piston movement during the induction stroke being smaller than the radius of curvature of the sections of the inner periphery of the guide recess determining piston movement during the compression, expansion and exhaust strokes, of the operating cycle.

The relevant section of the outer periphery of the guide recess is that extending from the point at which the piston, at its top dead centre position, begins to be pulled downwards by the curvature of the outer periphery for some 50° of rotation of the guide recess. The relevant sections of the inner periphery of the guide recess are those corresponding to the bottom dead centre positions of the piston and extending for some 45° on each side of the bottom dead centre position.

The invention also provides a mechanism including:

a piston-and-cylinder assembly including a first piston housed in a first cylinder and a second piston housed in a second cylinder, a first pin member passing through the first piston and a second pin member passing through the second piston and a guide member having a guide recess accommodating an end of the first pin member and an end of the second pin member, the guide recess being so shaped and orientated in relation to the piston-and-cylinder assembly that a common axis exists between the guide recess and the piston-and-cylinder assembly, the guide member and the piston-and-cylinder assembly being so mounted as to be rotatable relative to each other about the common axis and the guide recess being a figure-8 in shape bounded by an outer and an inner periphery, for guiding the pin members continuously in a figure-8 path, causing the piston to sweep up and down the cylinder, when the guide member and the piston-and-cylinder assembly rotate relative to each other, the radius of curvature of the section of the outer periphery of the guide recess determining piston movement during the induction stroke being smaller than the radius of curvature of the sections of the inner periphery of the guide recess determining piston movement during the compression, expansion and exhaust strokes, of the operating cycle.

In one arrangement, the form of the piston-and-cylinder assembly permits the first and second cylinders to lie diametrically opposed to each other.

In an alternative arrangement, including a further cylinder, a further piston in the further cylinder and a further pin member passing through the further piston and being accommodated in the guide recess, the first, second and further cylinders being spaced 120° apart.

Yet another arrangement includes at least one further pair of diametrically opposed cylinders on the piston-and-cylinder assembly, further pistons in the further cylinders and further pin members passing through the pistons and being accommodated in the guide recess.

The arrangement may be such that the ratio of the radius of curvature of the section of the outer periphery of the guide recess determining piston movement during the induction stroke to the radius of the radius of curvature of the sections of the inner periphery of the guide recess determining piston movement during the compression, expansion and exhaust strokes lies in the range from about 0.95 to about 0.01, both limits included.

Further, the arrangement may be such that the ratio of the radius of curvature of the section of the outer periphery of the guide recess determining piston movement during the induction stroke to the radius of the radius of curvature of the sections of the inner periphery of the guide recess determining piston movement during the compression, expansion and exhaust strokes lies in the range from about 0.85 to about 0.15, both limits included.

Still further, the arrangement may be such that the ratio of the radius of curvature of the section of the outer periphery of the guide recess determining piston movement during the induction stroke to the radius of the radius of curvature of the sections of the inner periphery of the guide recess determining piston movement during the compression, expansion and exhaust strokes lies in the range from about 0.75 to about 0.25, both limits included.

Even further, the arrangement may be such that the ratio of the radius of curvature of the section of the outer periphery of the guide recess determining piston movement during the induction stroke to the radius of the radius of curvature of the sections of the inner periphery of the guide recess determining piston movement during the compression, expansion and exhaust strokes lies in the range from about 0.65 to about 0.35, both limits included.

Yet further, the arrangement may be such that the ratio of the radius of curvature of the section of the outer periphery of the guide recess determining piston movement during the induction stroke to the radius of the radius of curvature of the sections of the inner periphery of the guide recess determining piston movement during the compression, expansion and exhaust strokes lies in the range from about 0.55 to about 0.45, both limits included.

In a first preferred arrangement, the radius of curvature of the section of the outer periphery of the guide recess determining piston movement during the induction stroke is of the order of a half of the radius of curvature of the sections of the inner periphery of the guide recess determining piston movement during the compression, expansion and exhaust strokes.

In an alternative preferred arrangement, the radius of curvature of the section of the outer periphery of the guide recess determining piston movement during the induction stroke is of the order of two-thirds of the radius of curvature of the sections of the inner periphery of the guide recess determining piston movement during the compression, expansion and exhaust strokes.

Preferably, the radius of curvature of the section of the outer periphery of the guide recess determining piston movement during the induction stroke is of the order of between two-thirds and a half of the radius of curvature of the sections of the inner periphery of the guide recess determining piston movement during the compression, expansion and exhaust strokes.

Preferably, the mechanism includes a second guide member having a second guide recess accommodating the other end of the pin member or the other ends of the pin members, the second guide recess being so shaped and orientated in relation to the piston-and-cylinder assembly as to share the common axis existing between the first guide recess and the piston-and-cylinder assembly, the second guide recess being of the same form as the first guide recess.

The mechanism may include axial slots in the cylinder or the cylinders, the pin member or pin members engaging the axial slots, to serve as guide means to the piston or pistons and, where axial slots exist, preferably, the axial slots lie on a diameter of the cylinder or cylinders.

Alternatively, the mechanism may include guide means for the piston or pistons so positioned as to engage the piston shank or piston shanks.

Preferably, where guide means engage the piston shanks, the or each piston shank includes a rectangular portion and the guide means is of complementary shape and engages the rectangular portion of the or each piston shank.

Preferably, the or each piston shank includes an H-form transverse cross-section portion.

Preferably, the or each piston shank includes an H-form transverse cross-section portion and the horizontal element of the H projects beyond both of the vertical elements of the H.

In one arrangement of the mechanism, the common axis is the axis of a shaft on which the piston-and-cylinder assembly is rotatably mounted, the remainder of the mechanism being fixed.

In an alternative arrangement of the mechanism, the common axis is the axis of a shaft on which the guide member is rotatably mounted or the guide members are rotatably mounted, the piston-and-cylinder assembly being fixed.

In yet another arrangement of the mechanism, the common axis is the axis of a shaft on which the guide member is or the guide members are rotatably mounted and the piston-and-cylinder assembly is rotatably mounted on the shaft.

Preferably, the mechanism includes bearing means at the end of the pin member or the ends of pin members accommodated in the guide recess, for effecting rolling contact between the peripheries of the guide recess and the end of the pin member or the ends of the pin members.

Preferably, the bearing means at the end of the pin member or the ends of the pin members includes an outer bearing assembly contacting only the outer periphery of a guide recess and an inner bearing assembly contacting only the inner periphery of the guide recess.

Preferably, the outer bearing assembly includes an outer cylindrical shell supported by a plurality of outer rollers on the pin member, the outer cylindrical shell lying in contact with the outer periphery only of the guide recess.

Preferably, the inner bearing assembly includes an inner cylindrical shell supported by a plurality of inner rollers on the pin member, the inner cylindrical shell lying in contact with the inner periphery only of the guide recess.

In one arrangement, the outer and inner bearing assemblies are so mounted that the outer and inner cylindrical shells rotate about the same axis.

Preferably, the outer and inner bearing assemblies are so mounted that the outer and inner cylindrical shells rotate about the axis of the pin member.

In an alternative arrangement, the outer and inner bearing assemblies are so mounted that the outer cylindrical shell rotates about an axis which is offset from the axis about which the inner cylindrical shell rotates.

Advantageously, the bearing means includes a ball bearing between the outer and inner bearing assemblies, the balls of the ball bearing running in tracks in the outer and inner cylindrical shells.

Preferably, the mechanism includes a guide recess having an inner periphery including a step in its profile for accommodating bearing means at the end of the pin member or the ends of the pin members, the bearing means including an outer bearing assembly contacting only the outer periphery of a guide recess and an inner bearing assembly contacting only the inner periphery of the guide recess.

Preferably, the mechanism includes a guide recess having an outer periphery the surface of which is narrower than the surface of the inner periphery, bearing means at the end of the pin member or the ends of the pin members including an outer bearing assembly contacting only the narrower surface of the outer periphery of a guide recess and an inner bearing assembly contacting only the surface of the inner periphery of the guide recess.

Preferably, a plurality of apertures are included in the pin member or pin members for receiving and distributing lubricant to the end of the pin member or pin members.

Preferably, the guide member includes at least one aperture so positioned as to permit the delivery of lubricant through the guide member to the pin member or pin members.

An aspect of the invention is a mechanism including:

a piston-and-cylinder assembly including a piston housed in a cylinder, a pin member passing through the piston and a guide member having a guide recess accommodating an end of the pin member, the guide recess being so shaped and orientated in relation to the piston-and-cylinder assembly that a common axis exists between the guide recess and the piston-and-cylinder assembly, the guide member and the piston-and-cylinder assembly being so mounted as to be rotatable relative to each other about the common axis and the guide recess being a figure-8 in shape bounded by an outer and an inner periphery, for guiding the pin member continuously in a figure-8 path, causing the piston to sweep up and down the cylinder, when the guide member and the piston-and-cylinder assembly rotate relative to each other, the guide recess having an inner periphery including a step in its profile for accommodating bearing means at the end of the pin member or the ends of the pin members, the bearing means-including an outer bearing assembly contacting only the outer periphery of a guide recess and an inner bearing assembly contacting only the inner periphery of the guide recess.

Preferably, the mechanism includes a guide recess having an outer periphery the surface of which is narrower than the surface of the inner periphery, bearing means at the end of the pin member or the ends of the pin members including an outer bearing assembly contacting only the narrower surface of the outer periphery of a guide recess and an inner bearing assembly contacting only the surface of the inner periphery of the guide recess.

The invention also provides a guide member, for a piston-and cylinder assembly, having a guide recess accommodating an end of a pin member passing through a piston of the piston-and-cylinder assembly, the guide recess being a figure-8 in shape bounded by an outer and an inner periphery, for guiding the pin member continuously in a figure-8 path, the radius of curvature of the section of the outer periphery of the guide recess determining piston movement during the induction stroke being smaller than the radius of curvature of the sections of the inner periphery of the guide recess determining piston movement during the compression, expansion and exhaust strokes, of the operating cycle.

In one instance, the radius of curvature of the section of the outer periphery of the guide recess determining piston movement during the induction stroke is of the order of a half of the radius of curvature of the sections of the inner periphery of the guide recess determining piston movement during the compression, expansion and exhaust strokes.

IN an alternative, the radius of curvature of the section of the outer periphery of the guide recess determining piston movement during the induction stroke is of the order of two-thirds of the radius of curvature of the sections of the inner periphery of the guide recess determining piston movement during the compression, expansion and exhaust strokes.

Preferably, the radius of curvature of the section of the outer periphery of the guide recess determining piston movement during the induction stroke is of the order of between two-thirds and a half of the radius of curvature of the sections of the inner periphery of the guide recess determining piston movement 5uring the compression, expansion and exhaust strokes.

It is to be understood that the requirement for the guide recess to be of a generally figure-8 form means that the guide recess includes a mid-portion that is narrower than the two end lobe portions, arrangements in which the mid-portion is not narrower than the end lobe portions being excluded.

A heat engine may include a mechanism in accordance with the invention, wherein the pistons and cylinders are pistons and cylinders of the heat engine and, in operation, generate motive power for the mechanism.

The heat engine is, preferably, an internal combustion engine, for example, a Diesel-cycle engine or an Otto-cycle engine.

The engine may be a four-stroke engine or, alternatively, a two-stroke engine.

Figure 2:
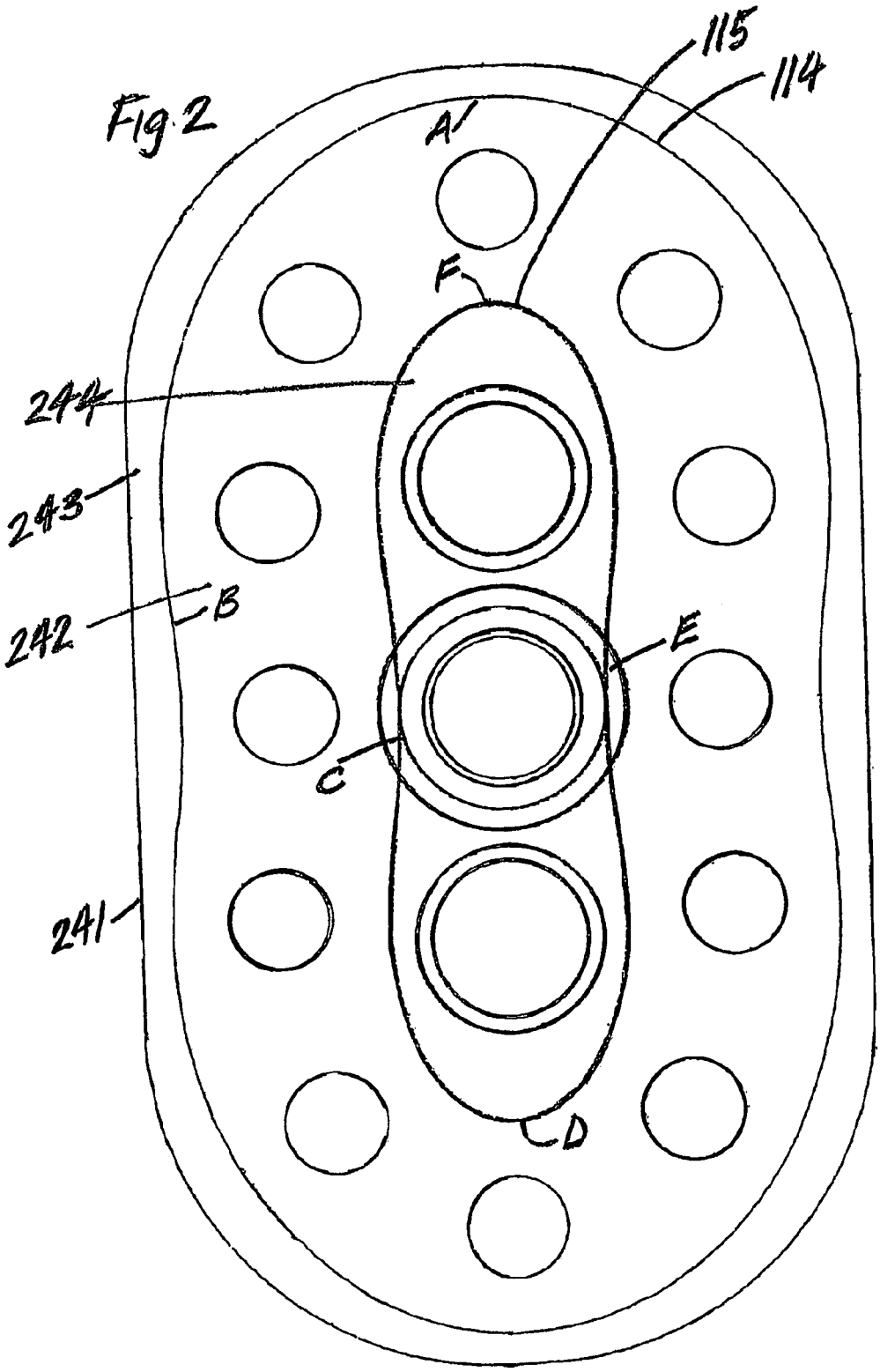
Figure 3:
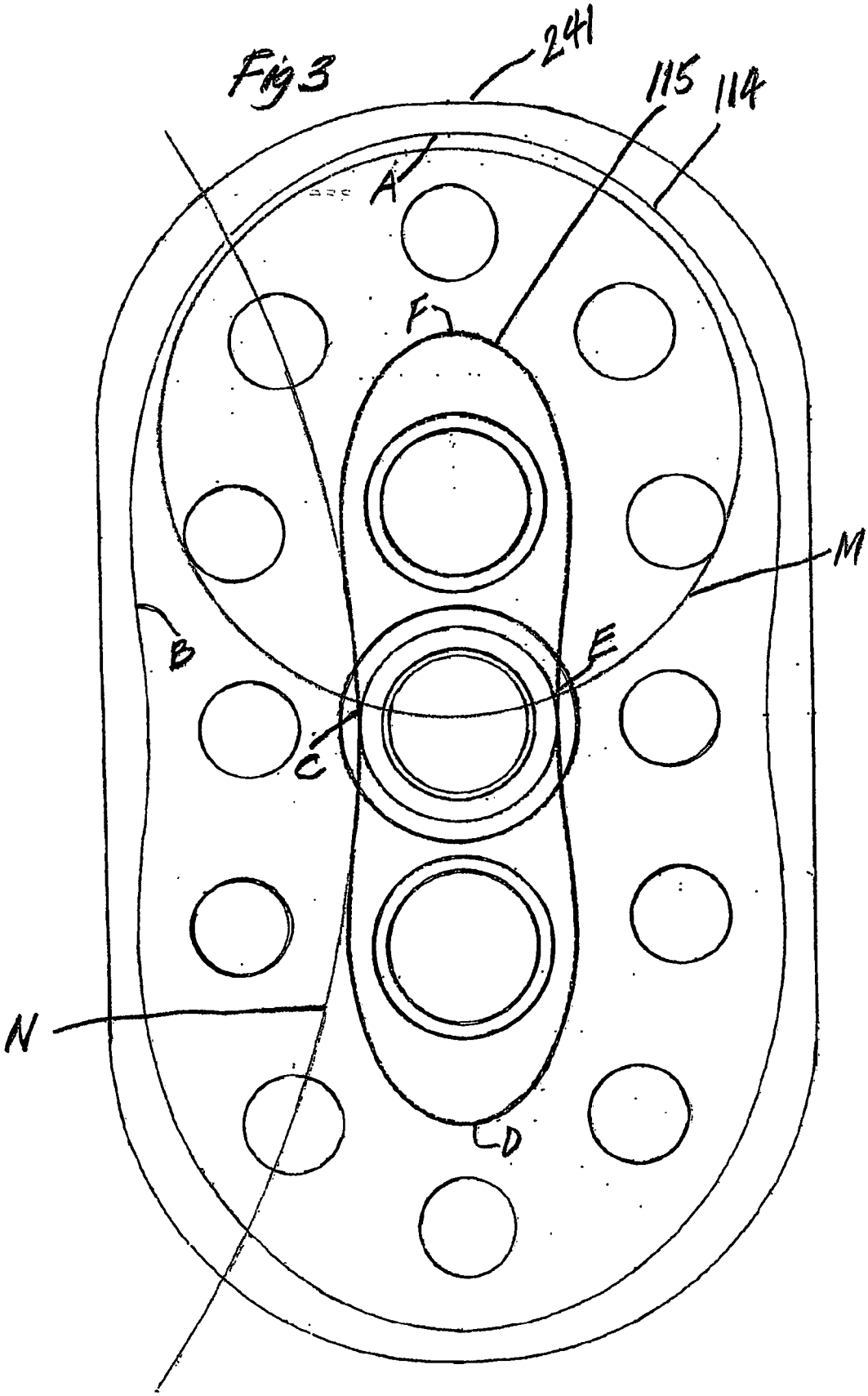
Figure 4A:
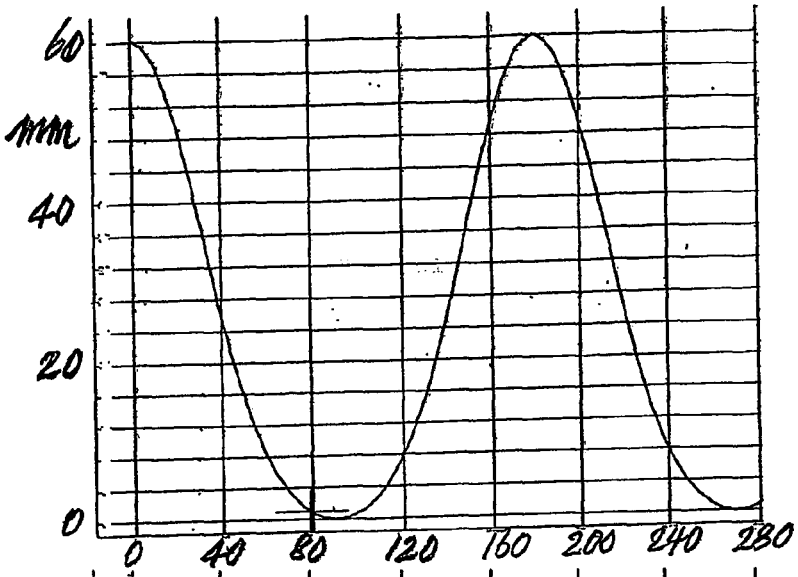
Figure 4B:
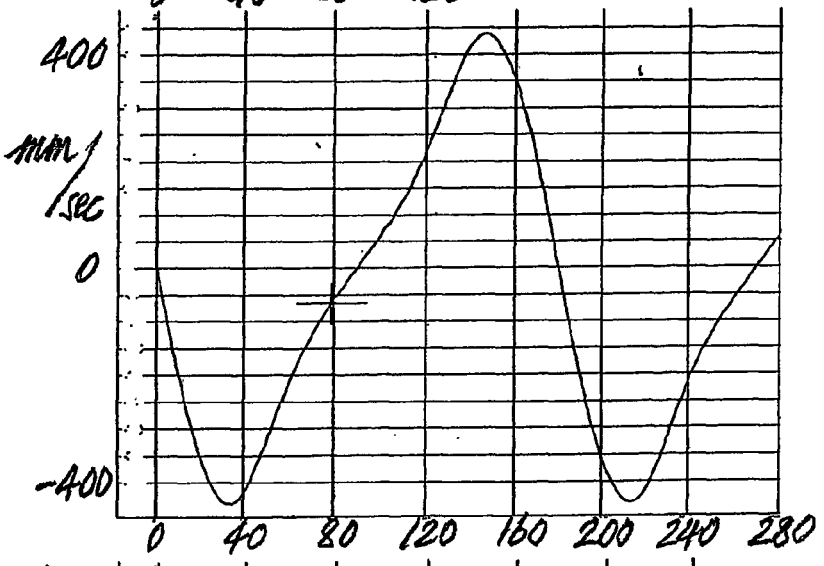
Figure 4C:
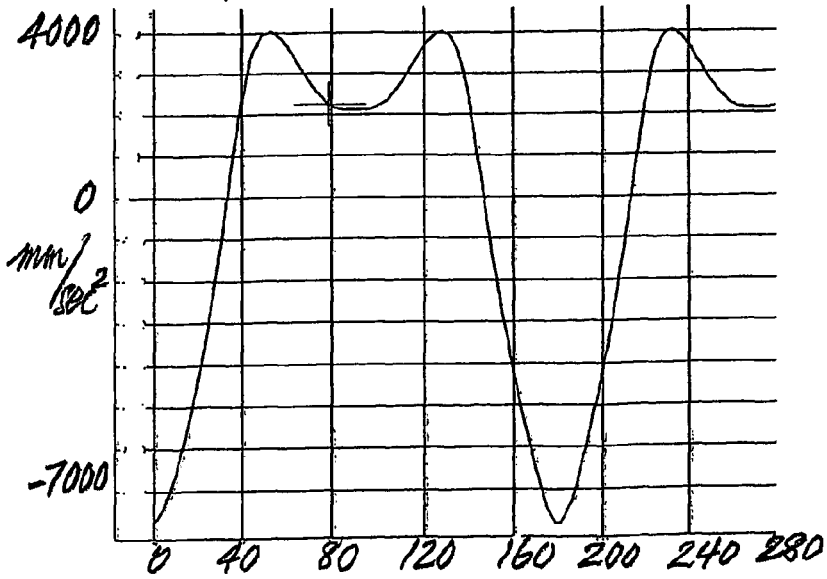
Figure 5:
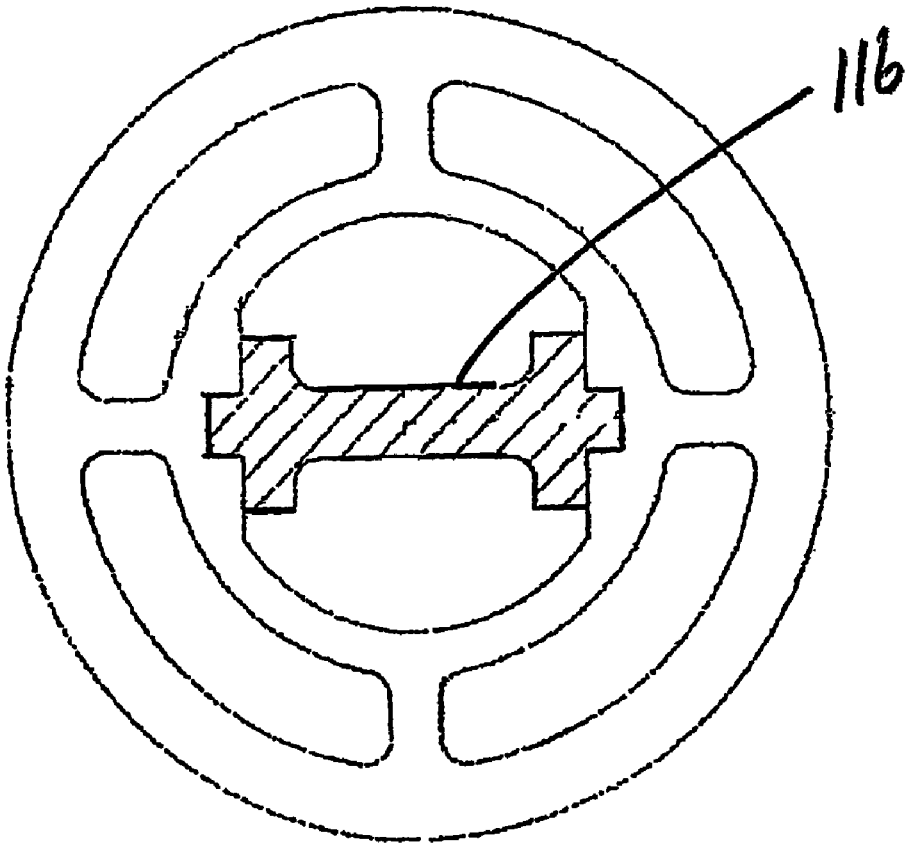
Figure 6:
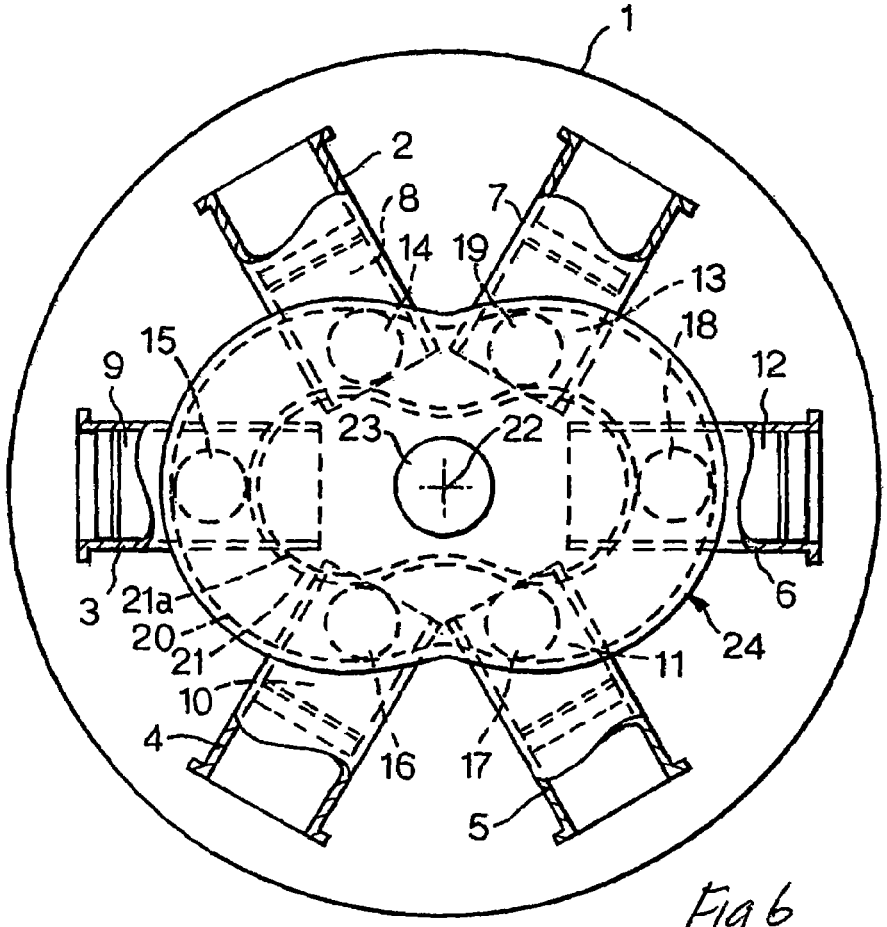
Figure 14:
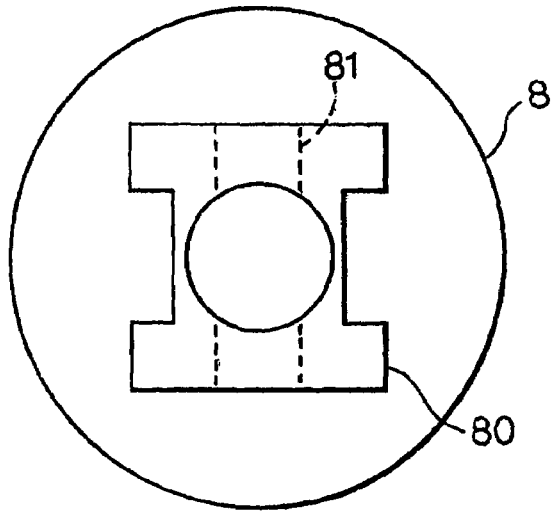
Figure 7:
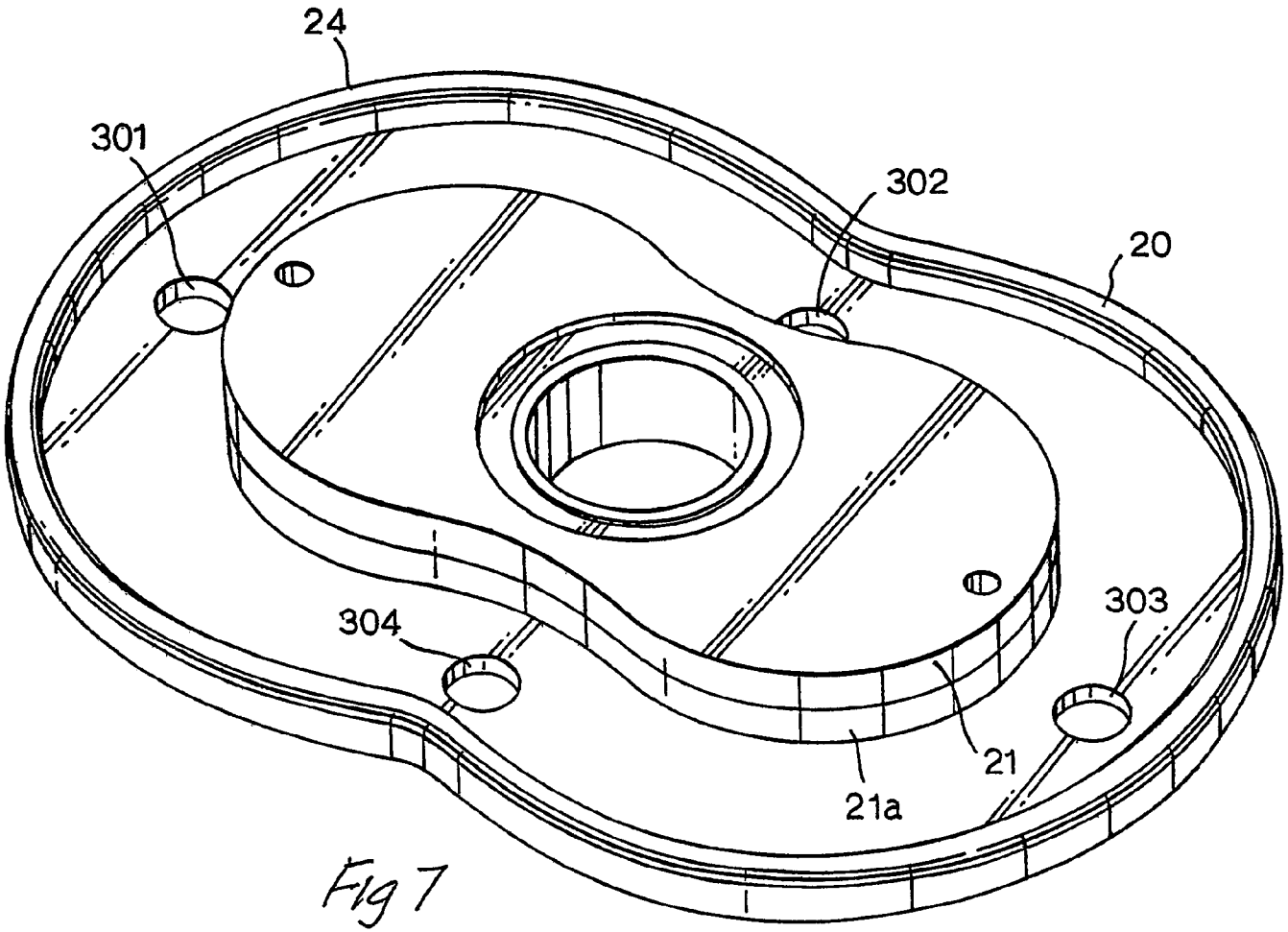
Figure 13:
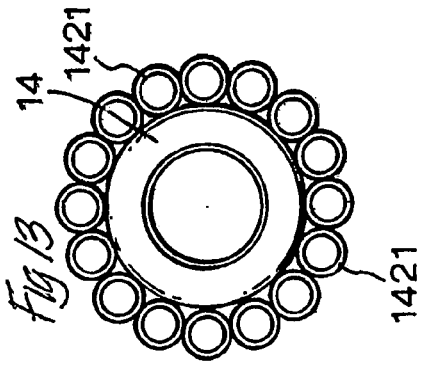
Figure 12:
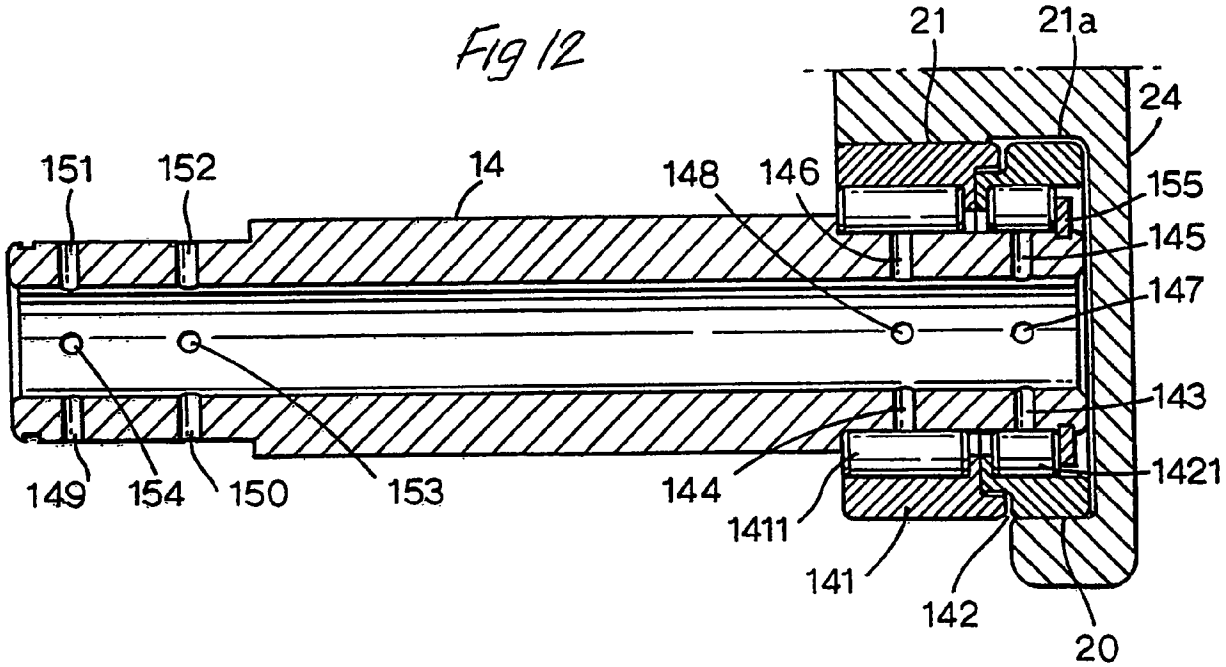
Figure 15:
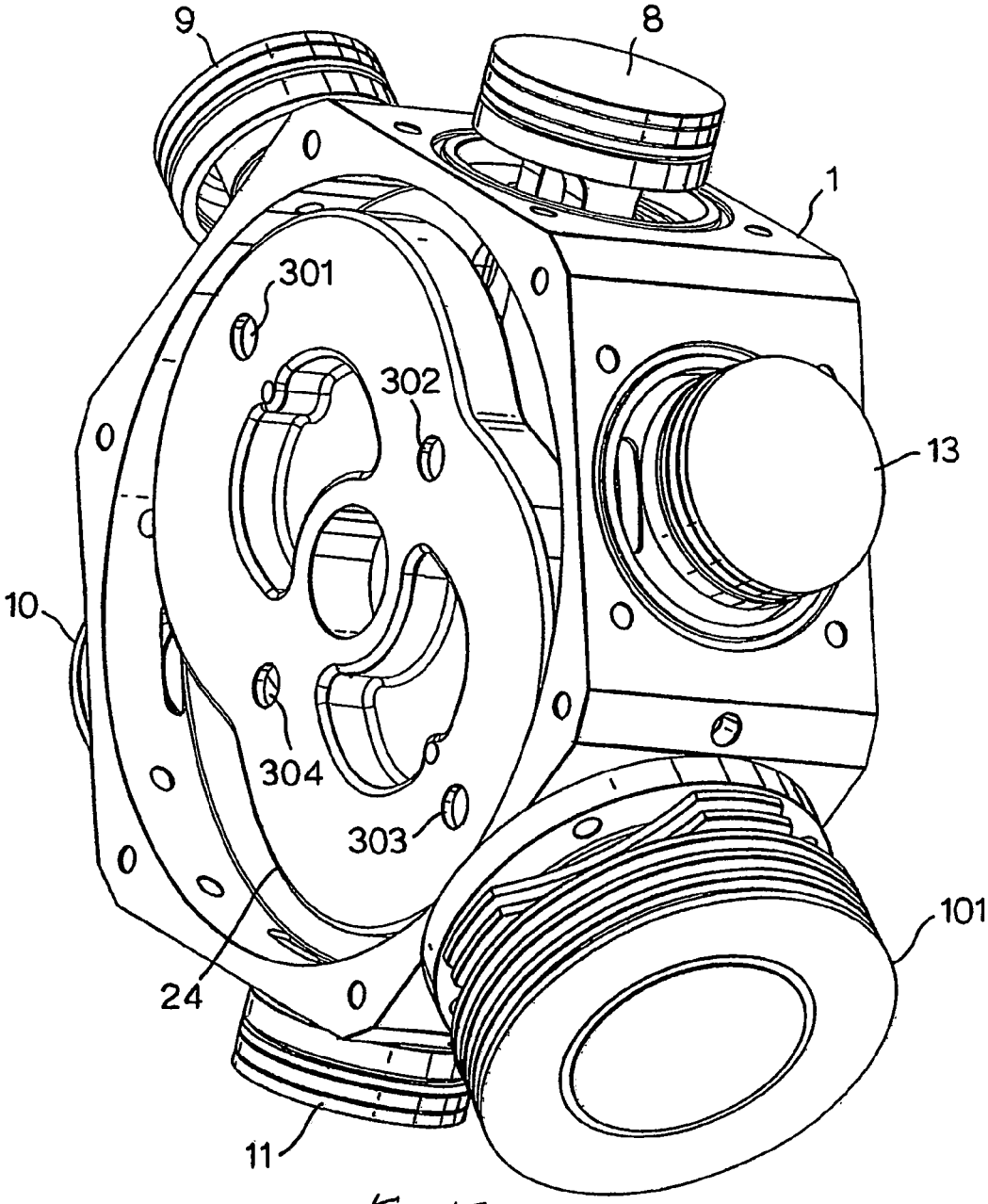

A mechanism in accordance with the invention will now be described by way of example only with reference to the accompanying drawings in which:

FIG. 1 is a diagrammatic representation of a first form of the mechanism showing a first form of guide recess included in a guide member accommodating four pin members and a piston-and-cylinder assembly having four cylinders, FIG. 2 represents a front view of the guide member of FIG. 1, FIG. 3 represents the front view of the guide member of FIG. 1 including inserted curves M and N relating to an analysis of the curvatures of the guide recess, FIGS. 4*a*, 4*b* and 4*c* are graphical representations of the displacement, velocity and acceleration, respectively, against the angular rotation of the guide member for any one of the pistons of the mechanism represented by FIG. 1, FIG. 5 represents a transverse cross-section taken through the shank of any one of the pistons of the mechanism of FIG. 1, FIG. 6 represents a front view of a second form of the mechanism showing a second form of guide recess included in a guide member accommodating six pin members and a piston-and-cylinder assembly having six cylinders mounted on a shaft, FIG. 7 represents a perspective view of the guide member of FIG. 6, FIG. 8 represents a front view of the guide member of FIG. 6, FIG. 9 represents a cross-section of the guide member of FIG. 8 taken along the line AA, FIG. 10 represents a cross-section of the guide member of FIG. 8 taken along the line BB, FIG. 11 represents a perspective outline view of the guide member of FIG. 8, FIG. 12 represents a cross-section through the axis of a pin member and a guide member showing roller bearings between the pin member and the guide member, applicable to the mechanisms represented by FIG. 1 and FIG. 6, FIG. 13 represents and end view of the pin member supported by a plurality of rollers belonging to the roller bearings of FIG. 12, FIG. 14 is a view from below of a piston for the piston-and-cylinder assembly of FIG. 6 and FIG. 15 is a perspective view of a partly assembled mechanism which includes six cylinders, showing the cylinder head, pistons and the guide member.

Referring to FIG. 1 of the accompanying drawings, a first form of the mechanism includes a piston-and-cylinder assembly including a housing 100 providing four cylinders 102 to 105 housing four pistons 106 to 109. Four pin members 110 to 113 pass through the shanks 116 to 119 of the pistons 106 to 109 and one set of the ends of the pin members 116 to 119 are accommodated in a guide recess having peripheries 114 and 115 in a guide member. The piston-and-cylinder assembly and the guide recess have a common axis 120. The piston-and-cylinder assembly is mounted on a shaft (not shown) the axis of which is the common axis 120. The guide member is attached to the shaft and is rotatable about the common axis 120.

The peripheries 114 and 115 of the guide recess and the pin members 110 to 113 are shown because of the purely diagrammatic nature of FIG. 1, although in practice they would not be visible in the view represented by FIG. 1. The ends of the pin members 110 to 113 are provided with outer and inner roller bearings. As viewed in the drawing, an outer roller bearing lies directly over an inner roller bearing. The outer roller bearings lie in contact with the periphery 114 of the guide recess and do not contact the periphery 115 of the guide recess. The inner roller bearings lie in contact with the periphery 115 and do not contact the periphery 114 of the guide recess. The arrangement whereby the roller bearings contact only one of the two peripheries 114 and 115 of the guide recess is explained below with reference to FIG. 12 of the accompanying drawings.

Although not shown in FIG. 1, the mechanism includes another guide member providing another guide recess for accommodating the other set of the ends of the pin members 110 to 113, the guide recesses being of the same shape.

The four cylinders 102 to 105 are not evenly spaced around the housing 100, the axes of adjacent cylinders being separated by either 60 degrees or 120 degrees. The housing 100 is, in practice, a substantially cylindrical cylinder block.

In the operation of the mechanism shown in FIG. 1, the guide member rotates about the common axis 120 and the pin members 110 to 113 move along the guide recess, the pistons 106 to 109 sweeping up and down the cylinders 102 to 105 as the pin members 110 to 113 move along the guide recess.

The mechanism shown in FIG. 1 forms a part of a heat engine in which the pistons and cylinders are pistons and cylinders of the heat engine and, in operation, generate motive power for the mechanism. The details of the heat engine are not shown in FIG. 1.

In the operation of the heat engine, mechanical energy is generated in the cylinders 102 to 105 and the pistons 106 to 109 as cylinders and pistons of the heat engine, causing the pistons 106 to 109 to reciprocate in the cylinders 102 to 105. The mechanical energy of the reciprocating pistons is translated into rotary motion of the guide member as a result of the pin members 110 to 113 moving along, the guide recess shown in FIG. 1 and the second guide recess which is not shown.

Poppet valves (not shown) are included in the heads of the cylinders 102 to 105 and are controlled by overhead camshafts of suitable profile for the required lift and dwell for the heat engine. A valve lifting mechanism may be included in the event that it is deemed necessary. In the case of a Diesel-cycle heat engine, provision may be made for operating an injection pump on the cylinder head or electrically operated injectors may be provided. Specific details of engine valve and fuel supply arrangements are not included since those matters are considered to be within the ability of a skilled person.

The operating gas, usually air, for the heat engine enters the heads of the cylinders 102 to 105 in the conventional manner by way of an inlet poppet valve or inlet poppet valves. The gas charges are compressed in the cylinders, fuel being added during an induction part of a stroke in the case of a petrol spark-ignition engine or during a compression part of a stroke in the case of a compression-ignition engine. Exhaust gases leave the heat engine by way of exhaust valves and an exhaust pipe. Engine lubrication is effected by a pressurised oil system and cooling is effected by a radiator. Specific details of engine lubrication arrangements are not included since the matter of adequate engine lubrication is considered to be within the ability of a skilled person.

Rotation of the output shaft is clockwise as viewed in FIG. 1. The guide member functions as a rotor, rotating with the output shaft which passes through the guide member, the shaft and guide member being locked together. The arrangement is ideal as regards balance since the opposed-piston configuration provides good-counter-balance. For good balance, a minimum of two cylinders is required and a three-cylinder arrangement with evenly spaced cylinders would also be balanced, although the mechanism is viable with a single cylinder.

Variation of the shapes of the guide recesses may be used in order to vary the performance of a heat engine including the mechanism. Variation of the size of the piston-and-cylinder assembly provides for different power requirements.

There are four parts to the guide recess corresponding to the induction, compression, expansion and exhaust strokes of the operating cycle of a reciprocating heat engine and, consequently, there is ignition once per revolution of the guide member for a four-stroke cycle. That contrasts with more conventional four-stroke arrangements, employing a crankshaft, in which there is ignition once every two revolutions of the crankshaft; thus a heat engine including the mechanism produces twice as many power strokes as a conventional four-stroke arrangement, leading improved power output at lower revolutions.

The induction, compression, expansion and exhaust strokes of the operating cycle of a heat engine may be examined more closely in relation to the shape of the guide recess by referring to FIG. 2 of the accompanying drawings, showing a front view of the guide member that permits an accurate representation of the peripheries 114 and 115 of the guide recess.

Referring to FIG. 2, the guide member 241 includes a plane base portion 242 supporting an outer wall portion 243 and an inner island portion 244. The outer periphery 114 of the guide recess is the inner periphery of the outer wall portion 243 and the inner periphery 115 of the guide recess is the periphery of the inner island portion 244, of the guide member 241. The outer periphery of the outer wall portion 243 of the guide member 241 defines the shape of the guide member 241 and includes two substantially straight parallel side elements joined by two rounded end elements.

The outer periphery 114 of the guide recess is of a generally figure-8 form, including a mid-portion, where the periphery is narrowest, between two end lobe portions, the outer periphery 114 being symmetrical both lengthwise and cross-wise. The inner periphery 115 of the guide recess is similarly of a generally figure-8 form, including a mid-portion where the periphery is narrowest, between two end lobe portions, the inner periphery 115 being symmetrical both lengthwise and cross-wise. The lines about which the outer and inner peripheries 114 and 115 of the guide member 241 are symmetrical are coincident.

If the guide member 241 as shown in FIG. 2 is regarded as rotating in the clockwise sense, the induction stroke of the operating cycle is controlled by the section AB of the outer periphery 114 of the guide recess, the piston being pulled downwards towards its bottom dead centre position at this time. Thereafter, the compression, expansion and exhaust strokes of the operating cycle are controlled by the sections CD, DE and EF of the inner periphery 115 of the guide recess, the piston first being pushed upwards towards its top dead centre position on the compression stroke, then pushing downwards on its way towards its bottom dead centre position during the expansion stroke and, subsequently, being pushed upwards towards its top dead centre position on the exhaust stroke. The piston motion is determined by the curvatures of the sections AB of the outer periphery 114 and the sections CD, DE and EF of the inner periphery 115, the guide recess. The relative curvatures of the relevant sections of the outer and inner peripheries 114 and 115 of the guide recess are examined in FIG. 3 of the accompanying drawings, which is a representation, to scale, of a practical guide member.

Although not shown in FIG. 2, the inner periphery of the guide recess of the guide member 241 includes a stepped profile, as described below in relation to FIGS. 7 and 11.

Referring to FIG. 3, a first circle M has been inserted to follow a part of the section AB of the outer periphery 114 of the guide recess that determines piston movement during the induction stroke of the cycle. A second circle N has been inserted to follow a part of the section of the inner periphery 115, adjacent to position C of the sections FC and CD, of the guide recess, that determines piston movement during the compression stroke of the cycle. It is evident that a third circle, of the same radius as the second circle N, may be inserted to follow the part of the sections DE and EF of the inner periphery of the inner guide slot 115 that determine piston movement during the expansion and exhaust strokes of the cycle. The radius of curvature corresponding to the circle M may be regarded as the predominant radius of curvature of the section of the outer periphery 114 of the guide slot corresponding to the induction stroke of the operating cycle. Similarly, the radius of curvature corresponding to the circle N may be regarded as the predominant radius of the sections of the inner periphery of the guide slot corresponding to the compression, expansion and exhaust strokes of the operating cycle. The radius of circle M is of the order of 5 cm and the radius of the circle N is of the order of 10 cm.

It follows that the predominant, radius of curvature of the section of the outer periphery 114 of the guide recess determining piston movement during the induction stroke is smaller than the predominant radius of curvature of the sections of the inner periphery 115 of the guide recess determining piston movement during the compression, expansion and exhaust strokes, of the operating cycle. The predominant radii of curvature during compression, expansion and exhaust are those which exert control on each side of and through the bottom dead centre position.

A ratio of 1:2 may exist between the two predominant radii of curvature referred to in relation to FIG. 3. The effects of the predominant radii of curvature on piston movement are shown in FIGS. 4*a*, 4*b* and 4*c* of the accompanying drawings.

Referring to FIG. 4*a*, piston displacement (in mm) between 0° and 280° is shown, where 0° represents bottom dead centre. If the parts of the curve adjacent to the top and bottom dead centre positions are considered, it is evident that the piston moves 12 mm in 20° around the bottom dead centre position while it moves 8 mm in about 30° around the top dead centre position, from which it is evident that piston movement between 0° and 90° differs from piston movement between 90° and 180° and it follows, in particular, that the curve departs significantly from a sinusoidal curve.

Referring to FIG. 4*b*, piston velocity (in mm/sec) is shown, further indicating that the displacement of the piston departs significantly from a sinusoidal curve since the velocity is not sinusoidal.

Referring to FIG. 4*c*, piston acceleration (in mm/sec/sec) is shown, indicating two equal occurrences of maximum positive acceleration in the region between 40° and 140° separated by a trough at about 90°, and a single occurrence of maximum negative acceleration. A measure of the variation of the rate of change of piston acceleration (referred to as "jerk" in the engine design art) may be derived from FIG. 4*c* in the region between 40° and 140°, since the two peak occurrences and trough indicate that "jerk" is zero at about 50°, 90° and 130°, being positive shortly before 50° and 130° and negative shortly after 50° and 130°.

In relation to FIG. 4*c*, the form of the guide recess is such as to provide, in a spark-ignition engine equipped with a guide recess, a reduced rate of change of acceleration compared with a crankshaft-equipped engine, at a critical time or critical times during maximum power generation. That is achieved by so shaping the guide recess in the range 7° to 15° after top dead centre of the piston as to give zero rate of change of acceleration, that is, zero "jerk", at some selected piston displacement, and relatively small positive and negative values of rate of change of acceleration on either side of the zero position. Such tailoring of the rate of change of acceleration cannot be achieved in a crankshaft-equipped engine where the pattern of the rate of change of acceleration is fixed by the more or less sinusoidal piston displacement.

Other possible ratios for the two curvatures lie within the ratio ranges 0.95 to 0.01, 0.85 to 0.15, 0.75 to 0.25, 0.65 to 0.35 and 0.55 to 0.45.

The conditions to which the parts of a piston-cylinder pair are subjected when maximum power is being developed by the piston-cylinder pair exert a great influence on the efficiency of the operation. In particular, efficiency may be improved by reducing the amount of energy wasted in the operation by controlling of the rate of change of piston acceleration at a critical time or critical times during maximum power generation. The control of the rate of change of piston acceleration also allows control of the maximum stresses to which the parts are subjected. Improved efficiency and reduced stresses are provided by reduced rate of change of acceleration at a critical time or critical times during maximum power generation.

The compression ratio for a spark-ignition (Otto cycle) engine may lie between 9:1 and 13:1 and the form of the guide recess provides top and bottom dead centre positions for the piston, in relation to the cylinder, which give a compression ratio, in the stated range, for the piston-cylinder pair. The form of the recess further provides adequate time period for the piston at about top dead centre for combustion to be substantially complete as the piston leaves the top dead centre position. The form of the guide recess for a spark-ignition engine ensures that there is sufficient volume is maintained in the cylinder throughout the firing period. Spark-ignition is initiated before the top dead centre position of the piston and the ignition point is varied to some degree according to the composition of the fuel, the mixture strength and various other factors. The combustion duration phase lasts for some 60° to 90° as it does for a conventional crankshaft engine.

The form of the guide recess is such that, in accordance with the aim in a conventional spark-ignition engine with a crankshaft, the maximum cylinder pressure power is generated in the cylinder at between 7° and 15° after top dead centre. The power generated in the cylinder at any time is the product of the force on the piston and piston speed. The force on the piston is the product of the pressure in the cylinder and the piston area, so the power generated is dependent on the pressure in the cylinder and the piston speed.

The compression ratio for a compression-ignition (Diesel cycle) engine may lie between 14:1 and 24:1 and corresponding considerations to the above apply in that case with appropriate adjustments.

Referring to FIG. 5 of the accompanying drawings, the transverse cross-section of the piston shank is as shown. As is evident from FIG. 5, the piston includes a shank 116 in the form of an H in transverse cross-section with the horizontal element of the H projecting beyond both vertical elements of the H. The projecting parts of the horizontal element are received in channels in the housing and the vertical elements bear on flat surfaces adjacent to the channels in the housing. The piston is therefore free to slide in the housing and restrained from twisting.

Referring to FIG. 6 of the accompanying drawings, the second form of the mechanism includes a piston-and-cylinder assembly including a cylindrical carrier member 1 providing six cylinders 2 to 7 housing six pistons 8 to 13. Six pin members 14 to 19 pass diametrically through the pistons 8 to 13 and one set of the ends of the pin members 14 to 19 are accommodated in a guide recess having peripheries 20, 21 and 21*a* in a guide member 24. The piston-and-cylinder assembly and the guide recess have a common axis 22. The piston-and-cylinder assembly is mounted on a shaft 23 the axis of which is the common axis 22. The guide member 24 is attached to the shaft 23 and is rotatable about the common axis 22.

The peripheries 20, 21 and 21*a* of the guide recess and the pin members 14 to 19 are shown dotted to indicate that they are not visible in the drawing as viewed. The ends of the pin members 14 to 19 are provided with outer and inner roller bearings. As viewed in the drawing, an outer roller bearing lies directly over an inner roller bearing. The outer roller bearings lie in contact with the periphery 20 of the guide recess and do not contact the periphery 21 of the guide recess. The inner roller bearings lie in contact with the periphery 21 and do not contact the periphery 20 of the guide recess. The arrangement whereby the roller bearings contact only one of the two peripheries 20 and 21 of the guide recess is explained below with reference to FIG. 12 of the accompanying drawings.

Although not shown in FIG. 6, the mechanism includes another guide member providing another guide recess for accommodating the other set of the ends of the pin members 14 to 19, the guide recesses being of the same shape.

The six cylinders 2 to 7 are evenly spaced around the cylindrical carrier member 1, their axes being 60 degrees apart. The cylindrical carrier member 1 is, in practice, a cylindrical cylinder block.

In the operation of the mechanism shown in FIG. 6, the guide member rotates about the common axis 22 and the pin members 14 to 19 move along the guide recess, the pistons 8 to 13 sweeping up and down the cylinders 2 to 7 as the pin members 14 to 19 move along the guide recess.

The mechanism shown in FIG. 6 forms a part of a heat engine in which the pistons and cylinders are pistons and cylinders of the heat engine and, in operation, generate motive power for the mechanism. The details of the heat engine are not shown in FIG. 6.

In the operation of the heat engine, mechanical energy is generated in the cylinders 2 to 7 and the pistons 8 to 13 as cylinders and pistons of the heat engine, causing the pistons 8 to 13 to reciprocate in the cylinders 2 to 7. The mechanical energy of the reciprocating pistons is translated into rotary motion of the guide member 24 as a result of the pin members 14 to 19 moving along the guide recess shown in FIG. 6 and the second guide recess which is not shown.

Poppet valves are included in the heads of the cylinders 2 to 7 and are controlled by overhead camshafts of suitable profile for the required lift and dwell for the heat engine. A valve lifting mechanism may be included in the event that it is deemed necessary. In the case of a Diesel-cycle heat engine, provision may be made for operating an injection pump on the cylinder head or electrically operated injectors may be provided. Specific details of engine valve and fuel supply arrangements are not included since those matters are considered to be within the ability of a skilled person.

The operating gas, usually air, for the heat engine enters the heads of the cylinders 2 to 7 in the conventional manner by way of an inlet poppet valve or inlet poppet valves. The gas charges are compressed in the cylinders, fuel being added during an induction part of a stroke in the case of a petrol spark-ignition engine or during a compression part of a stroke in the case of a compression-ignition engine. Exhaust gases leave the heat engine by way of exhaust valves and an exhaust pipe. Engine lubrication is effected by a pressurised oil system and cooling is effected by a radiator. Specific details of engine lubrication arrangements are not included since the matter of adequate engine lubrication is considered to be within the ability of a skilled person.

Rotation of the output shaft is clockwise as viewed in FIG. 6. The arrangement is ideal as regards balance since the opposed-piston configuration provides good counter-balance. For good balance, a minimum of two cylinders is required.

Variation of the shapes of the guide recesses may be used in order to vary the performance of a heat engine including the mechanism. Variation of the size of the piston-and-cylinder assembly provides for different power requirements.

There are four parts to the guide recess corresponding to the induction, compression, expansion and exhaust strokes of the operating cycle of a reciprocating heat engine and, consequently, there is ignition once per revolution of the guide member for a four-stroke cycle. That contrasts with more conventional four-stroke arrangements, employing a crankshaft, in which there is ignition once every two revolutions of the crankshaft; thus a heat engine including the mechanism produces twice as many power strokes as a conventional four-stroke arrangement, leading improved power output at lower revolutions.

Referring to FIGS. 7 and 11 of the accompanying drawings, perspective views of the guide member 24 show the outer periphery 20 of the guide recess and the surfaces making up the inner peripheries 21 and 21*a* of the guide recess of the guide member 24. Although not altogether evident in FIGS. 7 and 11, the surface of the outer periphery 20 is only about half the combined depth of the surfaces of the inner peripheries 21 and 21*a* and the guide recess as defined by the periphery 21*a* is wider than as defined by the periphery 21. The effects of the different depths of the surfaces of the peripheries 20, 21 and 21*a* and the different widths of the guide recess cause the roller bearings at the ends of the pin members 14 to 19 to contact only one periphery as is disclosed above. Lubrication ports 301, 302, 303 and 304 are also shown in FIGS. 7 and 11.

Referring to FIG. 8 of the accompanying drawings, the guide member 24 includes a guide recess which is symmetrical about the line AA and, also, about the line BB. The guide recess is dumbbell-shaped, including rounded end portions and narrowing between the rounded end portions. The peripheries 20 and 21 of the guide recess are visible.

The guide recess is so shaped as to provide linear motion of the piston, in relation to the angular rotation of the guide member, of a form similar, but not identical to that shown in FIG. 4*a*.

The guide recess is so shaped that the predominant radius of curvature of the section of the outer periphery 20 of the guide recess determining piston movement during the induction stroke is smaller than the predominant radius of curvature of the sections of the inner periphery 21 of the guide recess determining piston movement during the compression, expansion and exhaust strokes, of the operating cycle. A ratio of 1:1.5 may exist between the two predominant radii of curvature referred to in relation to FIG. 8, corresponding to the curves M and N of FIG. 3.

Also visible in FIG. 8 are the lubrication ports 301 to 304 in the guide member 24. Lubricant injected through the apertures 301 to 304 enters a pin member and is delivered to the caged needle rollers on the pin member through axial apertures shown in FIG. 12.

FIGS. 9 and 10 of the accompanying drawings show that the reduced depth of surface of the outer periphery 20 of the guide recess compared with the total depth of the surfaces 21 and 21*a* making up the inner peripheries of the guide recess of the guide member 24.

Referring to FIG. 12 of the accompanying drawings, a pin member such as the pin member 14, say, of FIG. 1 or FIG. 6 has bearing means including an outer bearing assembly and an inner bearing assembly. The outer bearing assembly includes an outer cylindrical shell 142 and a plurality of needle rollers 1421 supporting the outer cylindrical shell 142 on the pin member 14. The inner bearing assembly includes an inner cylindrical shell 141 and a plurality of needle rollers 1411 supporting the inner cylindrical shell 141 on the pin member 14. The inner cylindrical shell 141 includes a peripheral protrusion and the outer cylindrical shell 142 includes a peripheral depression into which the peripheral protrusion of the inner cylindrical shell 142 fits. The outer and inner bearing assemblies 142 and 141 are retained on the pin member 14 by a retaining clip 155 and the fact that the end diameter of the pin member is reduced in relation to the body of the pin member 14. The retaining clip 155 may be omitted and the bottom of the guide slot relied on to prevent the bearing assemblies from coming off the pin member 14.

The surface of the outer periphery 20 of the guide recess in the guide member 24 is narrower than the total width of the surfaces of the inner peripheries 21 and 21*a* of the guide recess in the guide member 24, there being a step between the two surfaces of the inner peripheries 21 and 21*a*. The step between the surfaces of the inner peripheries 21 and 21*a* of the guide recess in the guide member 24 causes the outer cylindrical shell 142 to run clear of the surface of the inner periphery 21*a* while in contact with the surface of the outer periphery 20 of the guide recess. The inner cylindrical shell 141 runs along the surface of the inner periphery 21 of the guide recess and runs clear of the surface of the outer periphery 20 which does not extend up to the inner cylindrical shell 141. The arrangement shown in FIG. 12 permits the pin member 14 to be guided along the guide recess in contact with the inner and outer peripheries of the guide recess, the inner and outer cylindrical shells rotating in opposite senses.

A ball bearing may be introduced at the interface between the inner and outer cylindrical shells 141 and 142 by providing tracks in the inner and outer cylindrical shells 141 and 142 where they interface and placing a plurality of balls in the tracks.

As shown in FIG. 12, the pin member 14 is a cylindrical tube and includes a first plurality of axial apertures 143 to 148 in the vicinity of the bearing means at the end of the pin member 14 giving access to the interior of the pin member 14. A second plurality of axial apertures 149 to 154 is provided at the opposite end of the pin member 14 giving access to the interior of the pin member 14. The axial apertures serve to distribute lubricant to the bearing means at the ends of the pin member 14, the lubricant being injected into the interior of the pin member 14 through apertures in the guide member 24.

Referring to FIG. 13 of the accompanying drawings, an end view of the pin member 14 at the bearing means shows that there are sixteen rollers 1421 included in the outer bearing assembly.

Referring again to FIG. 12, as an alternative to the arrangement shown in which the outer and inner bearing assemblies 141, 1411, 142, 1421 are so mounted as to rotate about the axis of the pin member 14, the outer bearing assembly 142, 1421 may be so mounted in relation to the mounting of the inner bearing assembly 141, 1411 that the outer cylindrical shell 1421 rotates about an axis which is offset from the axis about which the inner cylindrical shell 141 rotates. An offset in the axes of rotation serves to hold the outer and inner bearing assemblies 141, 1411, 142, 1421 more positively in contact with the surfaces 310 and 32*b*.

FIG. 14 of the accompanying drawings represents a view of a piston, for example, the piston 8 shown in FIG. 6 seen from below. As is evident from FIG. 14, the piston includes a shank 80 in the form of an H in transverse cross-section and has an axial aperture. A radial aperture 81 is provided for a pin member 14, say.

In one arrangement, an end of the pin member protrudes through a close-fitting axial slot in the wall of the cylinder 2 of FIG. 6 and into the guide recess in the guide member 24. In the arrangement including the close-fitting axial slot, the close-fitting axial slot and pin member serve as guide means for the piston, limiting the piston to substantially axial movement without twisting.

In an alternative arrangement, an end of the pin member protrudes through an aperture in the wall of the cylinder that does not restrict the radial movement of the pin member, into the guide recess of the guide member 24. In the alternative arrangement, guide means for the piston engage the piston shank, limiting the piston to substantially axial movement without wobbling or twisting. In the case of the piston shown in FIG. 14, the guide means for the piston is of complementary form to the H-section form of the piston shank.

FIG. 15 of the accompanying drawings shows a perspective view of a partly assembled arrangement, in accordance with the invention, in which are visible the cylindrical carrier member 1 in cylinders of which are housed pistons 8, 9, 10, 11 and 13, a cylinder head 101 being visible at the position occupied by the piston 12. Also visible is the guide member 24 including the lubrication ports 301, 302, 303 and 304.

The pistons of the arrangements described above may be stepped in diameter, having the smaller or smallest diameter at the position at which the pin member is accommodated.

A basic mechanism in accordance with the invention requires one piston and one cylinder with a pin member in engagement with one guide recess and an axial slot in the cylinder is not essential to the operation of the mechanism although a slot in the cylinder facilitates assembly and limits wobble and twisting of the piston.

The basic mechanism is operable as a part of a heat engine, but if driven, is operable as a pump.

The mechanism is suitable for inclusion in Diesel-cycle and Otto-cycle heat engines. Two-stroke as well as four-stroke forms of either type of heat engine may include a mechanism in accordance with the invention. In a four-stoke form of heat engine including a mechanism in accordance with the invention, one spark occurs during a revolution of the guide member while, in a two-stroke form of heat engine including the mechanism, two sparks occur during a revolution of the guide member.

The mechanism is also suitable for inclusion in a steam engine.

Further, either the piston-and-cylinder assembly or the guide member providing the guide recess may be rotatable or both may be rotatable to provide counter-rotating output shafts.

As is made clear above, balanced arrangements based on evenly spaced opposed cylinders are preferred and rotation of the guide member or members is preferred, although there are instances in which rotation of the piston-and-cylinder assembly is useful.

The axial slots in the cylinders could lie on a chord of the cylinder instead of a diameter of the cylinder but the position on the diameter leads to better balance.

The invention claimed is:

1. A mechanism comprising:

a piston-and-cylinder assembly including a piston housed in a cylinder;

a pin member passing through the piston and a guide member having a guide recess accommodating an end of the pin member;

the guide recess being so shaped and orientated in relation to the piston-and-cylinder assembly that a common axis exists between the guide recess and the piston-and-cylinder assembly, the guide member and the piston-and-cylinder assembly being so mounted as to be rotatable relative to each other about the common axis;

the guide recess including an inner periphery and an outer periphery, the inner and outer peripheries including respective mid-portions where the periphery is narrowest lying between two end lobe portions, for guiding the pin member continuously in a path which includes two end lobe portions separated by a narrower mid-portion;

rotation of the guide member and the piston-and-cylinder assembly relative to each other causing the piston to sweep up and down the cylinder; and the radius of curvature along the narrowest part of the narrower mid-portion of the inner periphery of the guide recess being always larger than the radius of curvature along the end lobe portion of the outer periphery of the guide recess.

2. A mechanism as claimed in claim 1 comprising:

a piston-and-cylinder assembly including a second piston housed in a second cylinder;

a second pin member passing through the second piston; and the guide member accommodating an end of the first pin member and an end of the second pin member in the guide recess.

3. A mechanism as claimed in claim 1, wherein the ratio of the radius of curvature along the said end lobe portion of the outer periphery of the guide recess relative to the radius of curvature along the narrowest part of the narrower mid-portion of the inner periphery of the guide recess lies in the range from about 0.95 to about 0.01, both limits included.

4. A mechanism as claimed in claim 3, wherein the ratio of the radius of curvature along the said end lobe portion of the outer periphery of the guide recess relative to the radius of curvature along the narrowest part of the narrower mid-portion of the inner periphery of the guide recess lies in the range from about 0.85 to about 0.15, both limits included.

5. A mechanism as claimed in claim 4, wherein the ratio of the radius of curvature along the said end lobe portion of the outer periphery of the guide recess relative to the radius of curvature along the narrowest part of the narrower mid-portion of the inner periphery of the guide recess lies in the range from about 0.75 to about 0.25, both limits included.

6. A mechanism as claimed in claim 5, wherein the ratio of the radius of curvature along the said end lobe portion of the outer periphery of the guide recess relative to the radius of curvature along the narrowest part of the narrower mid-portion of the inner periphery of the guide recess lies in the range from about 0.65 to about 0.35, both limits included.

7. A mechanism as claimed in claim 6, wherein the ratio of the radius of curvature along the said end lobe portion of the outer periphery of the guide recess relative to the radius of curvature along the narrowest part of the narrower mid-portion of the inner periphery of the guide recess lies in the range from about 0.55 to about 0.45, both limits included.

8. A mechanism as claimed in claim 1 comprising bearing means at the end of the pin member or the ends of pin members for effecting rolling contact between the peripheries of the guide recess and the end of the pin member or the ends of the pin members.

9. A mechanism as claimed in claim 8, wherein the bearing means at the end of the pin member or the ends of the pin members includes an outer bearing assembly contacting only the outer periphery of a guide recess and an inner bearing assembly contacting only the inner periphery of the guide recess.

10. A mechanism as claimed in claim 9, wherein the outer bearing assembly includes an outer cylindrical shell supported by a plurality of outer rollers on the pin member, the outer cylindrical shell lying in contact with the outer periphery only of the guide recess.

11. A mechanism as claimed in claim 10, wherein the outer and inner bearing assemblies are so mounted that the outer and inner cylindrical shells rotate about the same axis.

12. A mechanism as claimed in claim 11, wherein the outer and inner bearing assemblies are so mounted that the outer and inner cylindrical shells rotate about the axis of the pin member.

13. A mechanism as claimed in claim 10, wherein the outer and inner bearing assemblies are so mounted that the outer cylindrical shell rotates about an axis which is offset from the axis about which the inner cylindrical shell rotates.

14. A mechanism as claimed in claim 9, wherein the inner bearing assembly includes an inner cylindrical shell supported by a plurality of inner rollers on the pin member, the inner cylindrical shell lying in contact with the inner periphery only of the guide recess.

15. A mechanism as claimed in claim 1, including a guide recess having an inner periphery including a step in its profile for accommodating the bearing means at the end of the pin member or the ends of the pin members, the bearing means including an outer bearing assembly contacting only the outer periphery of a guide recess and an inner bearing assembly contacting only the inner periphery of the guide recess.

16. A mechanism as claimed in claim 1, including a guide recess having an outer periphery the surface of which is narrower than the surface of the inner periphery, the bearing means at the end of the pin member or the ends of the pin members including an outer bearing assembly contacting only the narrower surface of the outer periphery of the guide recess and an inner bearing assembly contacting only the surface of the inner periphery of the guide recess.

17. A guide member, for a piston-and cylinder assembly, having a guide recess including an inner periphery and an outer periphery, the inner and outer peripheries including respective mid-portions where the periphery is narrowest lying between two end lobe portions, providing a continuous path which includes two end lobe portions separated by a narrower mid-portion, the radius of curvature along the narrowest part of the narrower mid-portion of the inner periphery of the guide recess being always larger than the radius of curvature along the end lobe portion of the outer periphery of the guide recess.

18. A guide member as claimed in claim 17, wherein the radius of curvature along the said end lobe portion of the outer periphery of the guide recess is of the order of a half of the radius of curvature along the narrowest part of the narrower mid-portion of the inner periphery of the guide recess.

19. A guide member as claimed in claim 17, wherein the radius of curvature along the said end lobe portion of the outer periphery of the guide recess is of the order of two-thirds of the radius of curvature along the narrowest part of the narrower mid-portion of the inner periphery of the guide recess.

20. A guide member mechanism as claimed in claim 17, wherein the radius of curvature along the said end lobe portion of the outer periphery of the guide recess is of the order of between two-thirds and a half of the radius of curvature along the narrowest part of the narrower mid-portion of the inner periphery of the guide recess, both limits included.

* * * * *